US006955326B2

(12) United States Patent
O'Brien et al.

(10) Patent No.: US 6,955,326 B2
(45) Date of Patent: Oct. 18, 2005

(54) TONGUE SWITCH

(75) Inventors: Cory O'Brien, Coquitlam (CA); Gary Click, Birmingham, AL (US)

(73) Assignee: Vae Nortrak North America Inc., Cheyenne, WY (US)

( * ) Notice: Subject to any disclaimer, the term of this patent is extended or adjusted under 35 U.S.C. 154(b) by 33 days.

(21) Appl. No.: 10/290,625

(22) Filed: Nov. 7, 2002

(65) Prior Publication Data

US 2003/0222181 A1 Dec. 4, 2003

(30) Foreign Application Priority Data

May 29, 2002 (CA) ..... 2387824

(51) Int. Cl.[7] ..... E01B 7/00
(52) U.S. Cl. ..... 246/453; 246/274
(58) Field of Search ..... 246/453, 162, 246/274, 275, 276, 452, 442, 443, 437, 435 R, 467, 458, 468, 471, 382, 387, 389, 391, 392; 104/130.01, 130.06; 238/26

(56) References Cited

U.S. PATENT DOCUMENTS

| | | | | |
|---|---|---|---|---|
| 625,458 A | | 5/1899 | Nichols | |
| 832,949 A | * | 10/1906 | Bailey | 246/443 |
| 1,489,285 A | | 4/1924 | Stewart et al. | |
| 1,493,163 A | | 5/1924 | Salsich | |
| 1,528,569 A | | 5/1925 | Salsich et al. | |
| 1,564,340 A | | 12/1925 | Garlick | |
| 1,585,185 A | | 5/1926 | Collins | |
| 1,853,981 A | | 4/1932 | Kimmel | |
| 1,854,022 A | * | 4/1932 | Dixon | 246/443 |
| 2,030,231 A | * | 2/1936 | Steward et al. | 246/435 R |
| 2,069,904 A | * | 2/1937 | Vangel | 246/437 |
| 2,231,232 A | | 2/1941 | Theodos | |
| 2,377,273 A | | 5/1945 | Siebert | |
| 3,564,236 A | * | 2/1971 | Ernst | 246/415 A |
| 4,005,839 A | * | 2/1977 | Frank | 246/415 R |
| 4,251,042 A | | 2/1981 | Frank | |
| 4,634,087 A | | 1/1987 | Kempa | |
| 4,890,804 A | * | 1/1990 | Teramoto et al. | 246/453 |
| 5,224,672 A | * | 7/1993 | Testart | 246/415 R |
| 5,577,691 A | | 11/1996 | Erich et al. | |
| 6,568,601 B2 | * | 5/2003 | Maynard | 238/292 |

OTHER PUBLICATIONS

Slot Switch Throw Linkage.
Switch Throw Mechanism Assembly F/LH Switch.
Electric Locomotive–Switch Stand and Slot Tongue.

* cited by examiner

*Primary Examiner*—Frantz F. Jules
(74) *Attorney, Agent, or Firm*—Michael A. Glenn; Glenn Patent Group

(57) ABSTRACT

A modular tongue switch assembly comprises a tongue pivotally connected to a slide surface, held down by a pivot retainer. The slide surface consists of slide plate sections removably attached to corresponding bed plate sections, which are in turn welded onto a base plate. Floating brace blocks hold a non-integral stock rail in place on the base plate. When the tongue moves, a horizontal lever arm actuates an inner box assembly housed within an outer box and containing the conductor rail, allowing the passing train to maintain contact with the conductor rail, if necessary. A novel rodding and lever arrangement is used.

34 Claims, 13 Drawing Sheets

TONGUE SWITCH

TECHNICAL FIELD OF THE INVENTION

This invention relates to a tongue switch assembly for use in embedded or paved railway track systems.

BACKGROUND OF THE INVENTION

Prior art tongue switch assemblies typically involve a single cast piece that includes flangeways, turnout rail segments and closure rail segments, with the principal separate and removable component being the tongue itself. This arrangement gives rise to certain difficulties. Movement of the tongue tends to wear the underlying surface of the assembly. If the wear becomes such that replacement is required, the entire assembly must be replaced.

One method used to connect the tongue to the underlying assembly is by pivoting it about the heel end (see e.g. U.S. Pat. No. 2,377,273 to Siebert). The pivot point consists of a pin extending downward from the tongue and inserted into a recess in the underlying switch base. A bearing surface is sometimes provided between the pin and the recess (see, e.g. U.S. Pat. No. 1,853,981 to Kimmel) to protect the pin or pivot from the impact and shearing forces it experiences when the train wheels pass over it. However, this bearing surface must be properly lubricated to ensure that the tongue moves smoothly and the entire pivot point must also be protected from the elements to ensure that it continues to function properly. It is therefore known to provide a cover plate, often integral to the wheel path, over the tongue heel to protect the pivot point (see e.g. U.S. Pat. No. 625,458 to Nichols). However, passage of the train over the cover plate tends to wear the cover plate and its hold down points.

Motion of the tongue between its two extreme positions requires a switch machine powerful enough to overcome not only the weight of the tongue itself, but also the frictional forces between the tongue and the underlying surface. It is therefore important to minimize this friction. One approach to reducing friction is to use lubricants spread on the slide plate surface. However, the application and replacement of lubricant is costly and time-consuming. It is also known to provide friction-reducing coverings for the slide surface. These coverings can take the form of a spray-coated ceramic, as in U.S. Pat. No. 4,890,804 to Teramoto, or a self-lubricating plastic insert, as in U.S. Pat. No. 5,127,613 to Germann. However, once the coating has worn away or if the slide surface itself is damaged, the entire assembly must be replaced. Another approach is to use a slide chair or roller assembly to carry the tongue. Slide chair or roller assemblies are more complex than simply applying lubricant, and they must frequently be replaced.

Tongue switch assemblies are often used in embedded or paved track systems (see e.g. U.S. Pat. No. 4,251,042 to Frank). In such systems, the tongue switch assembly is embedded in pavement or concrete, making it difficult to replace or maintain the switch.

Embedded tongue switch assemblies also present an additional problem when used in association with electric locomotives. In such cases, a current-carrying conductor rail typically lies inside an embedded trough that runs parallel to the load-bearing rails. A collector extends from the train to make physical contact with the conductor rail. When the switch is thrown, the conductor rail must be repositioned and reoriented to accommodate the new position of the tongue so that a consistent distance is maintained between the rail and the collector. It has been proposed to accomplish this by enclosing the conductor rail in a movable inner box assembly enclosed within a switchbox. Movement of the inner box assembly and its associated conductor rail is actuated by means of a lever arm mounted vertically between the switchbox and the load-bearing rail, with an arm extending the lever arm to the underside of the inner box assembly. However, such location of the lever arm would present particular difficulties in maintaining or replacing the lever arm. Access to the lever arm is difficult in that the entire switchbox must be disengaged and removed from its embedded position along with portions of the trackwork or the tongue switch assembly. In addition, it has been proposed to cast the outer shell of the movable switchbox as a single aluminum piece for ease of installation, but this would make it relatively weak and difficult to manufacture.

It is an object of the present invention to provide a tongue switch assembly that is easy to maintain, repair and replace as necessary, even in embedded or paved tracks.

It is a further object of the present invention to simplify the maintenance required for the wear surface of the tongue switch assembly by eliminating the need for lubricants.

It is yet a further object of the present invention to provide a pivot retainer for the tongue which is not subject to the impact and increased wear caused by passing trains.

It is another object of the present invention to provide a novel inner and outer switchbox assembly that is relatively easy to fabricate.

It is a further object of the present invention to provide a novel inner and outer switchbox assembly and associated lever arm that is easy to access and maintain, and that requires a minimum of adjustment in the field.

These and other objects of the invention will be appreciated by reference to the summary of the invention and to the detailed description of the preferred embodiment that follow.

SUMMARY OF THE INVENTION

The invention provides a modular tongue switch assembly wherein the major components are individually removable and replaceable. The overall assembly is easily transported, installed, replaced and maintained, even when installed in an embedded or paved track system.

The tongue switch assembly has as its major replaceable parts a tongue, several non-contiguous slide surface plate sections and a stock rail. These replaceable parts all rest on top of the underlying bed and base plates. The tongue is pivotally connected at its heel to one of the slide surface plate sections. A pivot retainer, consisting of a flat piece bolted down over the edge of the tongue heel, prevents displacement of the tongue from the pivot point when trains pass over the tongue. Upon removal of the pivot retainer, the tongue can be removed from the assembly for repair or replacement. The surfaces of the slide plate sections are finely machined, reducing the need for lubricant while still ensuring the tongue moves smoothly across the slide plate sections.

The slide plate sections are removably bolted to corresponding bed plate sections. The bed plate sections are welded to the base plate. These plates together provide strength and stability for the tongue switch assembly. The bed plate sections are narrower than the base plate and rest against the inner web of the stock rail, providing support and helping to keep the stock rail in position.

The stock rail is seated in a rail seat machined into the base plate. Floating brace block assemblies are bolted over the base and against the outer web of the stock rail, holding the stock rail in proper position. The floating brace block assemblies consist of a brace and a wedge block, bolted into place against a wedge block support welded to the base plate. This method of positioning and holding the stock rail in place allows relatively quick and simple removal of the stock rail, if necessary.

The invention also provides a novel inner and outer switchbox assembly that allows a conductor rail to be repositioned along with the tongue. The inner switchbox moves with the tongue, guided by a lever arm and rodding between the tongue and the inner switchbox. The conductor rail runs through the inner switchbox, and thus also moves with the tongue. This allows the train collector to maintain contact with the conductor rail at all points throughout the turn. The inner switchbox is a formed piece with welded ends, making it relatively easy to construct. Most of the switchbox assembly is completed before the tongue switch assembly is shipped to the customer, reducing installation time. The lever arm and rodding assembly between the tongue and the inner switchbox is placed on the field side of the box assembly. It is also placed horizontally, allowing access to both ends of the lever arm, to facilitate proper adjustment of the components of the box assembly. Any connections that must be made or adjusted in the field are thus relatively simple and accessible, further reducing maintenance and down time for the track.

In one of its aspects, the invention comprises a railroad tongue switch assembly having a substrate with a releasably engageable tongue that pivots about a pivot point and a stock rail removably seatable in the assembly.

The stock rail may be releasably held in place by removable braces which may be floating brace blocks, comprising a brace block, a wedge block support and a wedge block. The wedge block may be vertically bolted to the assembly substrate.

One or more slide plate sections, on which the tongue pivots, may be releasably attachable to the substrate, such as by bolts.

In another aspect of the invention, the tongue switch assembly may further comprise a retainer releasably mountable over the tongue pivot point. In one embodiment, the heel end of the tongue comprises a portion at rail level and a shoulder, at least a portion of said shoulder being lower than flange depth and the pivot retainer is attached to the substrate so as to overlay this heel end of the tongue.

In a further aspect of the invention, a seat for the stock rail is machined into the substrate. The substrate comprises a bottom surface and at least two top surfaces, all at different elevations. The stock rail may be removably seatable on the lower one of the top surfaces and the stock rail seat is machined into that lower one of the top surfaces.

In yet a further aspect, the tongue switch assembly may comprise one or more bed plate sections at least partially overlaying and secured to a base plate. The bed plate sections may be welded to the base plate. The stock rail seat may be machined into a top surface of the base plate that is not overlain by any of the bed plate sections.

In another aspect, the tongue switch assembly substrate has a machined seat to accommodate an end of a closure rail to which the assembly is to be connected.

In another embodiment, the tongue switch assembly comprises a substrate to which one or more slide plate sections are releasably attached, a pivoting tongue releasably engageable into one of the slide plate sections, a stock rail removably seatable on the substrate, and a stock rail seat machined into the substrate. In one aspect of this embodiment, the substrate comprises a bottom surface and at least two top surfaces, all at different elevations. The slide plate sections are attached on the higher one of the top surfaces, and the stock rail is seated on the lower one of the top surfaces. Further, the stock rail seat may be machined in the lower of the top surfaces.

In another aspect, the heel end of the tongue comprises a portion at rail level and a shoulder. At least a portion of the shoulder is lower than flange depth. The retainer is releasably attachable to said substrate so as to overlay the lower portion of the shoulder. Further, the lower portion of the shoulder may be laterally offset from the flangeway, and the retainer may cover substantially only the laterally offset portion of the shoulder when the retainer is attached to the substrate.

In another aspect, the invention comprises a box assembly for use in association with a railroad tongue switch assembly comprising a movable tongue. The box assembly comprises a first enclosure wherein a second enclosure is mounted for movement within the first enclosure, a rod assembly connecting the movable tongue to a lever arm mounted within the first enclosure and a slave rod connecting the lever arm to the second enclosure and at least one conductor rail mounted within the second enclosure.

The second enclosure of the box assembly may be mounted for sliding movement within the first enclosure. Further, the second enclosure may be pivotally mounted. A bolt and bronze bearing may be used to pivotally mount the second enclosure.

In another aspect of the invention, the lever arm within the first enclosure is mounted adjacent to the second enclosure and on the field side thereof. In a further aspect, the rod assembly between the tongue and the lever arm extends horizontally under the second enclosure.

In yet a further embodiment, the tongue switch assembly comprises a tongue switch, a box assembly and a pivot retainer, comprising a tongue pivotable on a plate and having a portion at rail level and a shoulder, at least a portion of which is lower than flange depth and a retainer releasably attachable to said plate so as to overlay the lower portion of the shoulder.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

The preferred embodiment of the invention will be described by reference to the drawings in which.

DETAILED DESCRIPTION OF THE PREFERRED EMBODIMENT OF THE INVENTION

Figure 1:
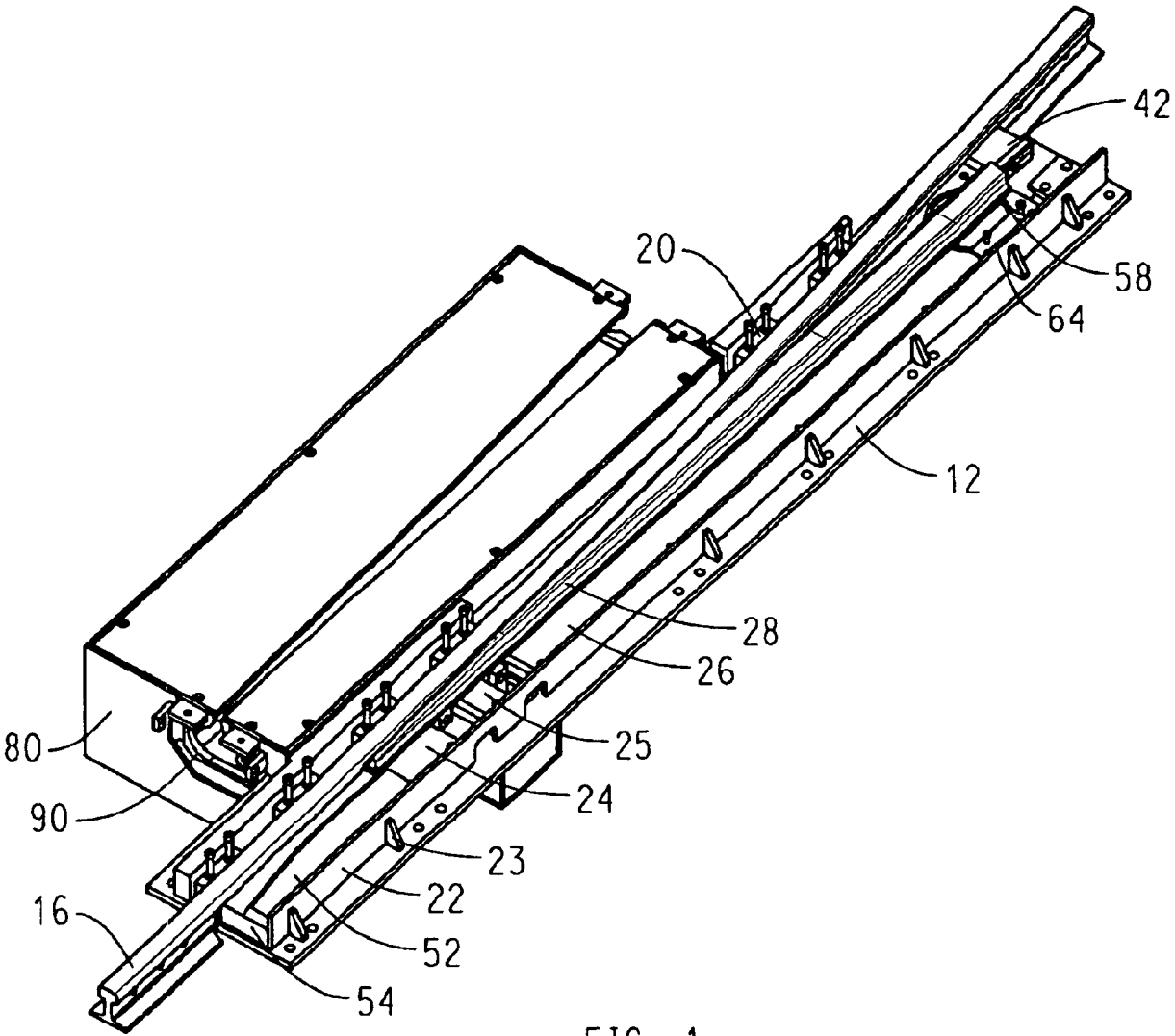
FIG. 1 is an isometric view of the assembly, as it would be inserted into the turnout.
Figure 2:
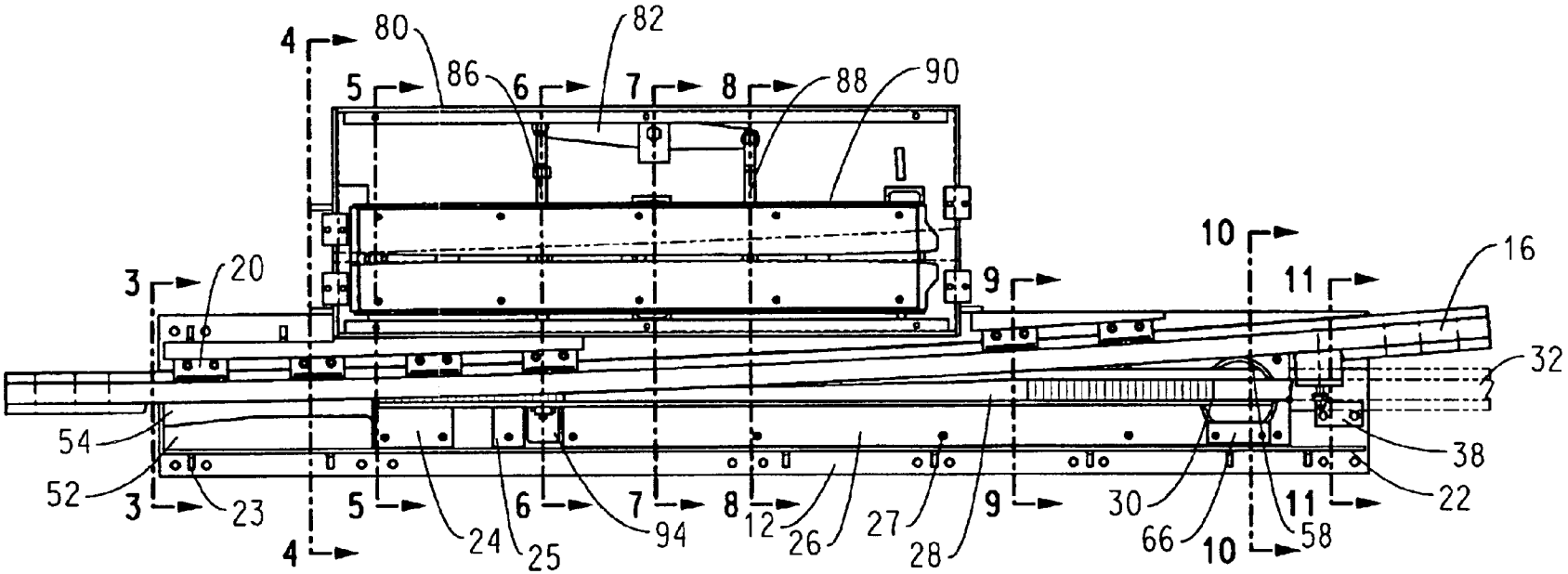
FIG. 2 is a plan view of the assembly shown in FIG. 1.
Figure 2A:
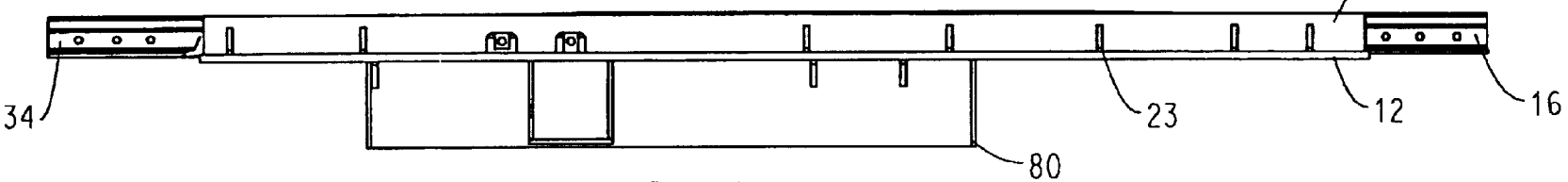
FIG. 2*a* is a side view of the assembly shown in FIG. 2.

FIGS. 1, 2 and 2*a* show the preferred embodiment of the assembly of the invention, as inserted into a section of embedded or paved trackwork, for use with an electrically-powered train.

Figure 3:
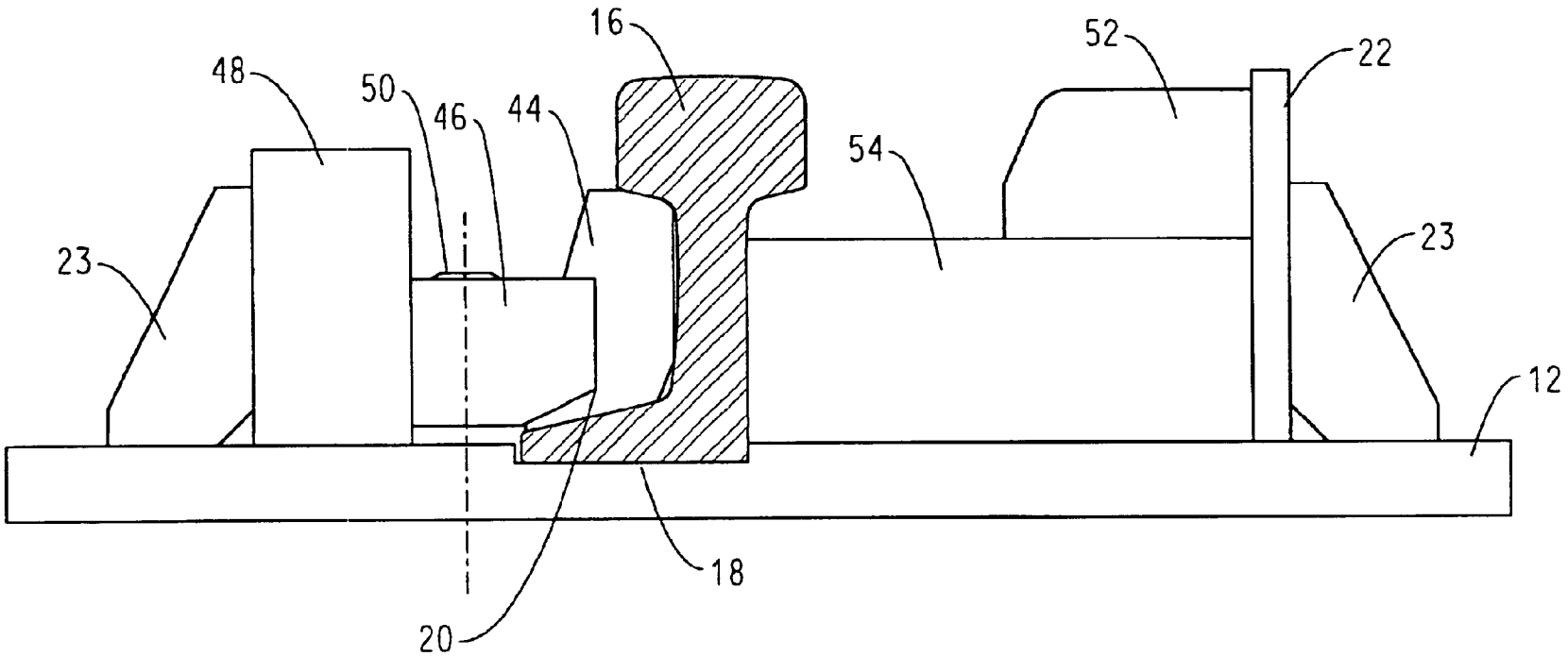
FIG. 3 is a cross-section of the assembly taken on line 3—3 of FIG. 2, showing the toe of the tongue switch assembly.
Figure 12:
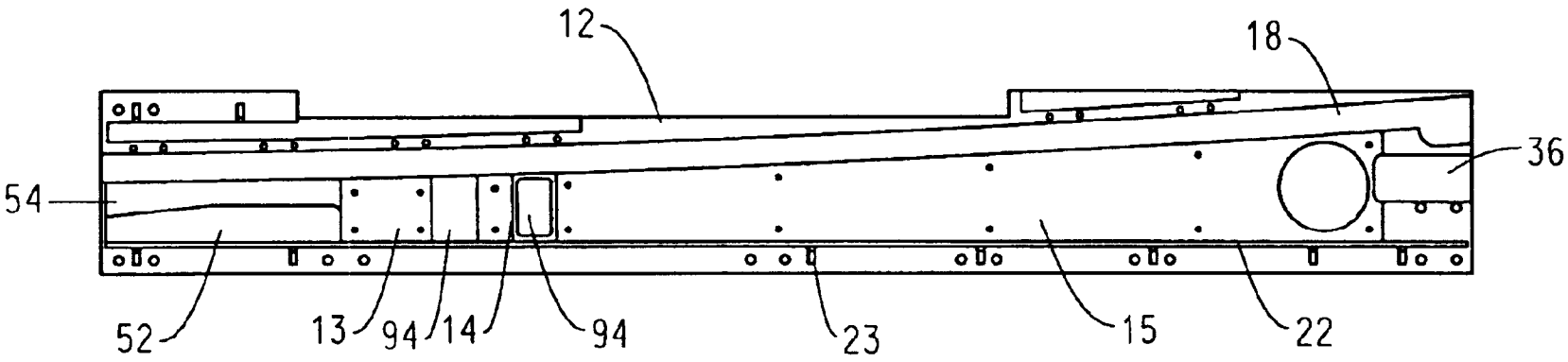
FIG. 12 is a plan view of the base plate and bed plate sections of the assembly, showing the rail seats machined therein, and the slots through which the tongue may be connected to the horizontal lever arm and the switch machine.

The switch generally rests on base plate 12. Bed plate sections 13, 14, 15 are welded on top of base plate 12, as seen in FIG. 12. Stock rail 16 is seated on base plate 12 and is held in place by rail seat 18 that has been machined into base plate 12 and by floating brace block assemblies 20, as seen in FIG. 3. Referring again to FIGS. 1, 2, and 2*a*, concrete barrier plate 22 keeps the surrounding concrete out of the switch. Gussets 23 stiffen concrete barrier plate 22. Slide plate sections 24, 25, 26 are bolted on top of corresponding bed plate sections 13, 14, 15 by bolts 27 (see FIGS. 5 and 7 for illustrations of the connections between slide plate sections 24, 26 and base plate sections 13, 15 respectively). A tongue 28, pivoted at its heel 30, pivots across the surface of slide plate sections 24, 25, 26 to direct the path of the train wheels. As tongue 28 moves, its motion also translates to the inner switchbox 90 adjacent to the switch as will be discussed below.

Figure 11:
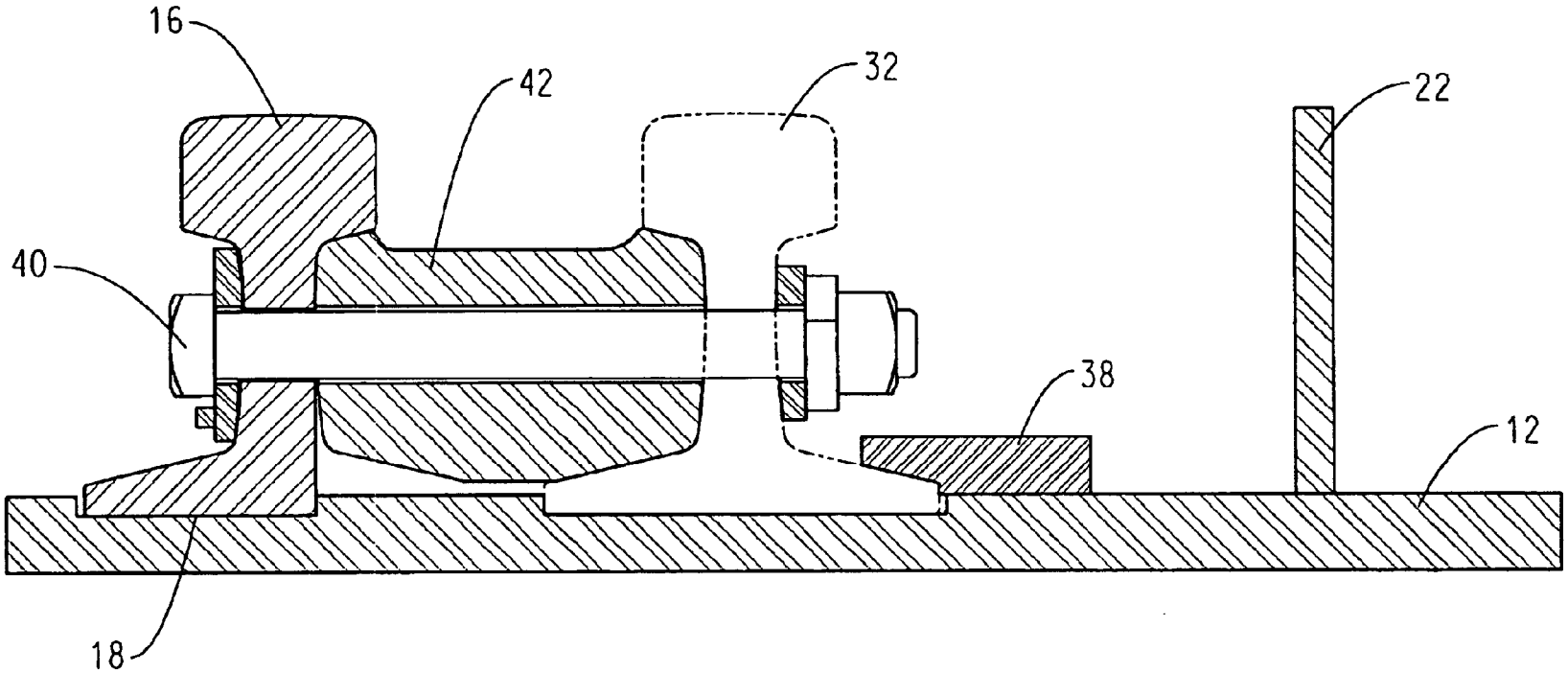
FIG. 11 is a cross-section of the assembly taken on line 11—11 of FIG. 2, showing the heel block and the heel block bolt between the closure and stock rails.

Stock rail 16 runs the length of the assembly. At the toe end of the switch, holes drilled into stock rail 16 allow joining with joint bar 34 to the closure rail, while similar holes at the heel end of the switch allow joining of stock rail 16 to the turnout rail, as seen in FIGS. 2 and 2*a*. As best seen in FIG. 2, closure rail 32 is located near the heel end of the switch and abuts tongue 28. Closure rail 32 rests in rail seat 36 (not shown) machined into base plate 12. FIG. 12 best shows the placement of rail seat 36 in base plate 12, relative to stock rail seat 18. As shown in FIG. 11 closure rail 32 is held in place by rail clips 38. Closure rail 32 and stock rail 16 are bolted together by bolt 40, extending through a steel or iron heel block 42 inserted to maintain proper support and separation. This eliminates the need to weld the assembly into place, which decreases installation time and down time for the track.

The various components of the assembly are completely fabricated, with the exception of tongue 28, which is cast out of manganese steel. Fabricated parts are considered to be beneficial in the contemplated application, in that parts replacement is made easier and quicker.

Base plate 12, best shown in FIG. 12, supports the entire tongue switch. Base plate 12 is preferably 1" thick. Rail seats 18, 36 for non-integral stock rail 16 and for the end of closure rail 32 are machined into base plate 12. Rail seats 18, 36 are preferably ¼" deep to properly support the rail base. Base plate 12 also supports vertical concrete barrier plates 22, which separate the operative components of the tongue switch from the surrounding concrete.

Figure 4:
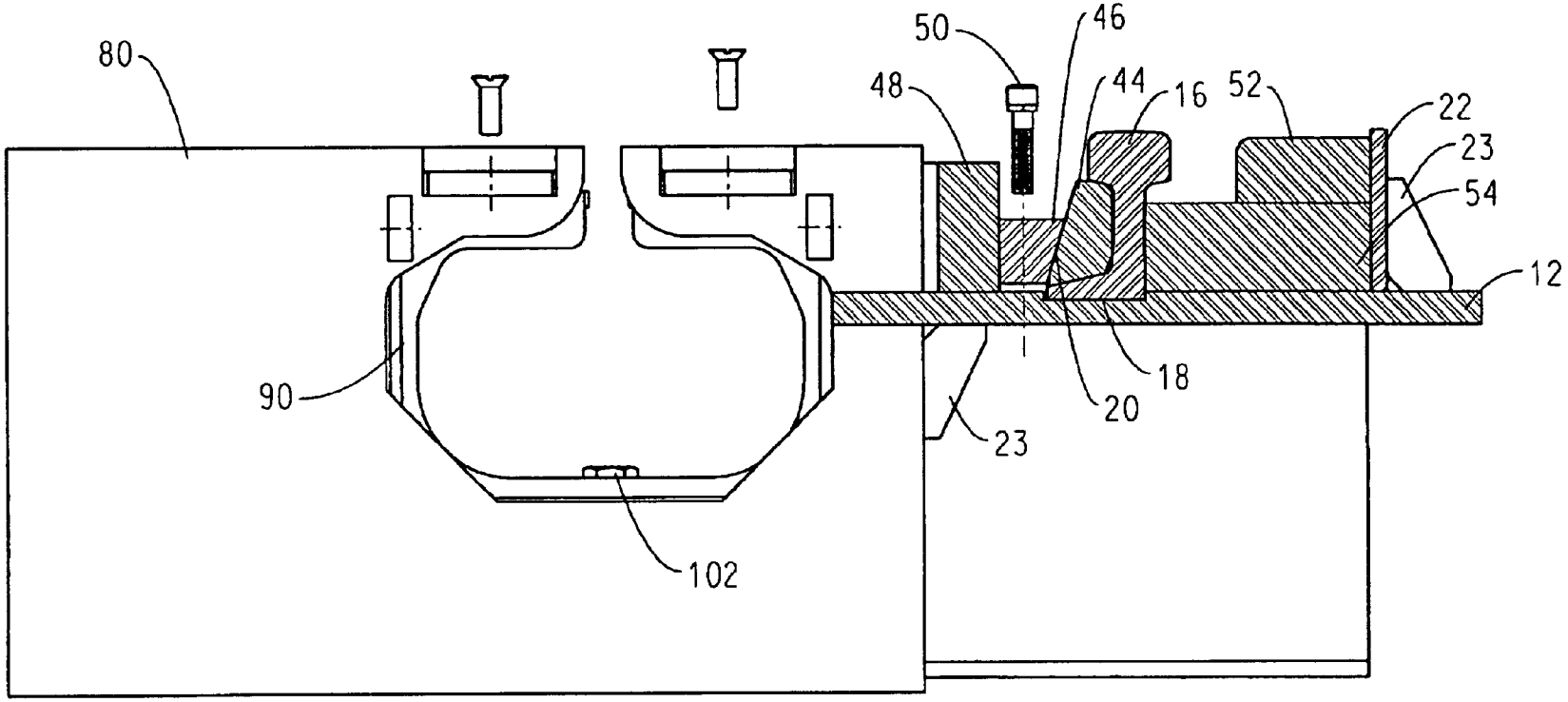
FIG. 4 is a cross-section of the assembly taken on line 4—4 of FIG. 2, showing the toe end of the box assembly.

The toe of the switch is shown in FIGS. 3 and 4, illustrating stock rail 16, held in place by floating brace block assembly 20, which will be described more fully later. The toe of the assembly also includes entry flare plate 52 and flare plate base 54, which ensure the train flanges are correctly positioned on the track.

Figure 6:
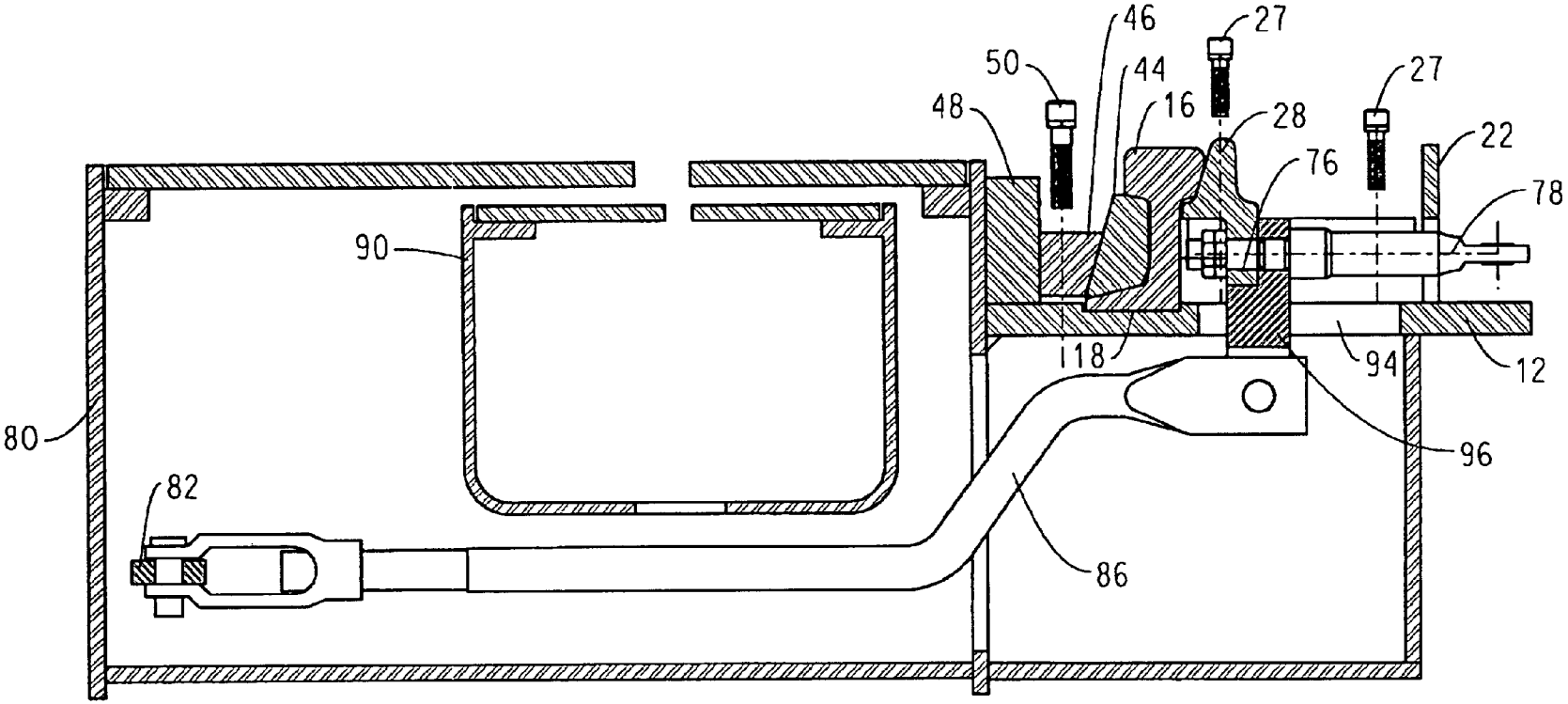
FIG. 6 is a cross-section of the assembly taken on line 6—6 of FIG. 2, showing the rodding connecting the tongue to the horizontal lever arm.

Referring to FIG. 6, a switch machine (not shown) moves tongue 28 across slide plate sections 24, 25, 26. The switch machine moves tongue 28 in and out of its abutment with stock rail 16. The switch machine and tongue 28 are connected via tongue lug 76 extending downward from tongue 28, between the first slide plate section 24 and the second slide plate section 25 and between first bed plate section 13 and second bed plate section 14. The position of the tongue lug slot 94 between slide plate sections 24, 25 through which the tongue lug extends is best shown in FIG. 12.

Figure 10:
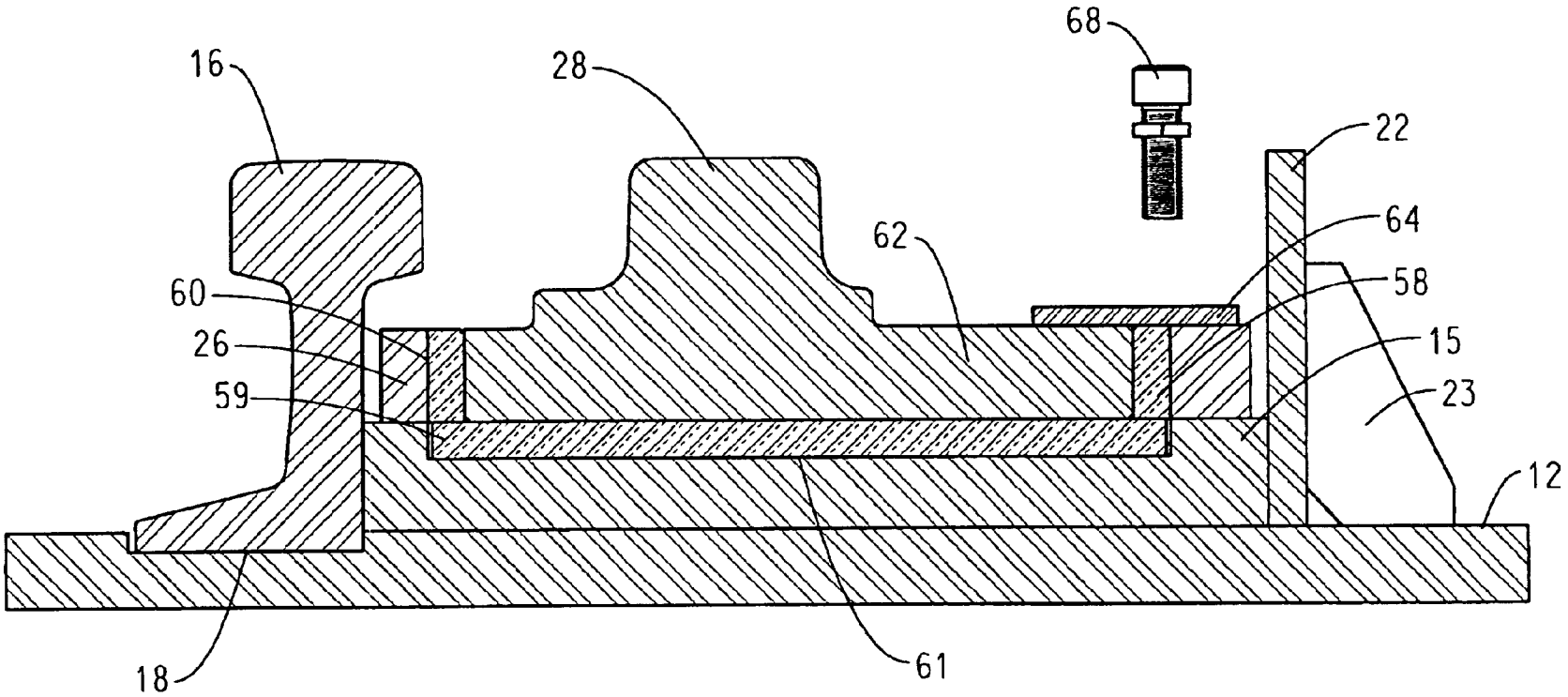
FIG. 10 is a cross-section of the assembly taken on line 10—10 of FIG. 2, showing the pivot point, pivot retainer and pivot bearing surfaces.

The profile of cast manganese steel tongue 28 is a Samson cut style, normally referred to in the industry as a Samson point. Tongue 28 pivots at tongue heel 30. The pivot point, which is best seen in FIG. 10, consists of bronze bearing surface 58 inserted into recess 60 in the third slide plate section 26 and resting on bronze pivot bearing disc 59 inserted into recess 61 in third bed plate section 15. A tight fit is achieved by inserting cooled bearing surfaces 58, 59 into slide plate recess 60 and bed plate recess 61, respectively. When bearing surfaces 58, 59 warm up, they expand, fitting snugly into recesses 60, 61. Pin 62, depending from tongue 28, is then inserted into bronze bearing surface 58. Bearing surfaces 58, 59 can be impregnated with lubricant prior to assembly to reduce friction in the pivot. Bearing surface 58 is accessible from the top of the switch, allowing the addition of lubricant as needed to ensure continued smooth functioning of tongue 28.

Tongue 28 is generally held in place by its own weight. As a result, a cover plate is not strictly required to hold down tongue 28. However, pivot retainer 66 provides additional restraint to tongue 28 when the wheels run over the switch, thus ensuring that the resulting vibrations and weight of the train do not displace tongue 28. The position of pivot retainer 66 is shown is FIG. 1, while FIG. 10 shows a cross-section of tongue heel 30 and pivot retainer 66. Pivot retainer 66 consists of rectangular piece 64, bolted down over the edge of flat, circular tongue heel 30 with bolts 68. Pivot retainer 66 sits outside and below the flangeway and therefore does not interfere with the wheel, nor is it subject to direct impact from passing wheels. Upon removal of pivot retainer 66, tongue 28 may be removed from the rest of the switch and replaced if necessary.

Figure 5:
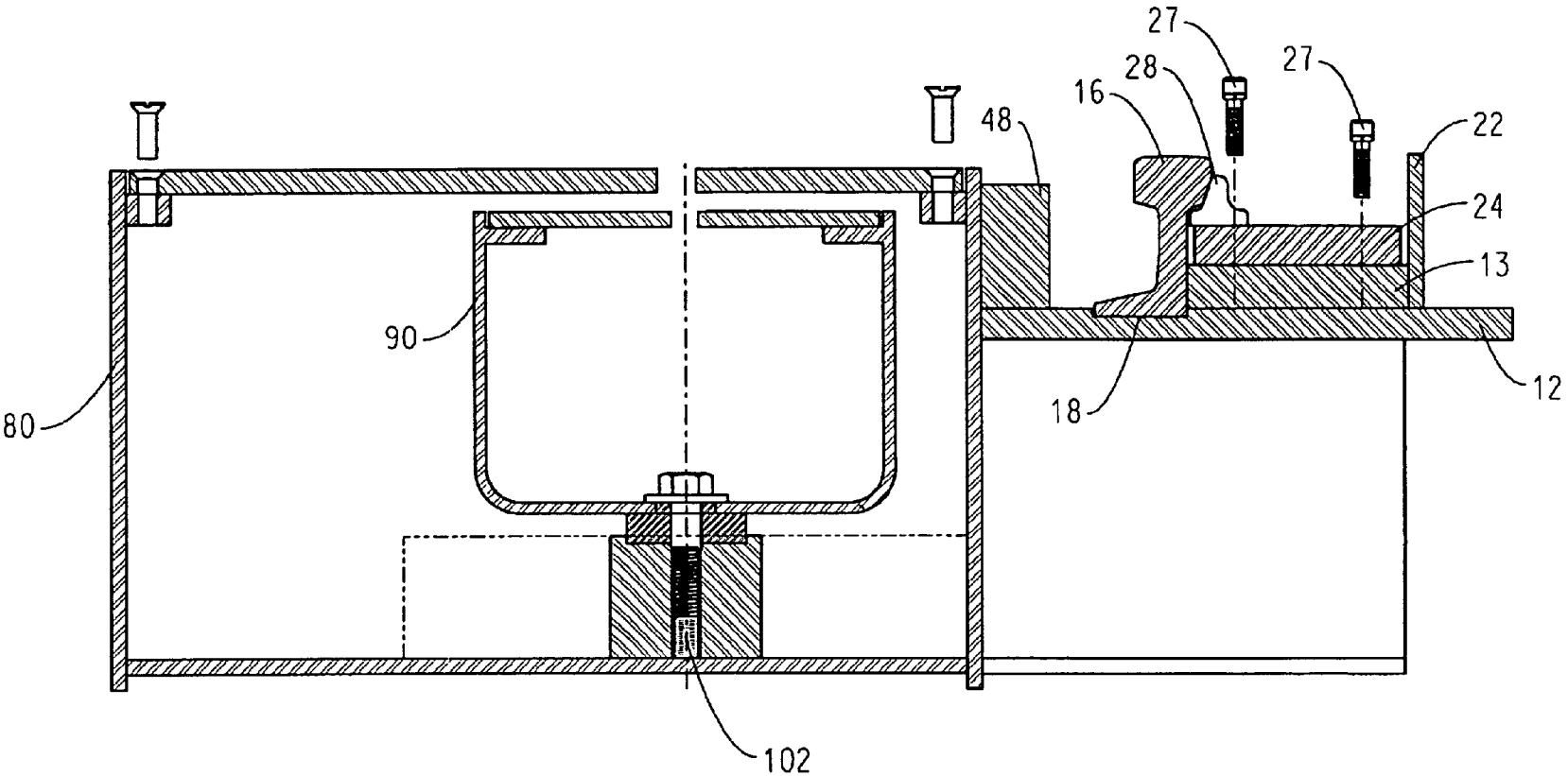
FIG. 5 is a cross-section of the assembly taken on line 5—5 of FIG. 2, showing the bolt about which the inner switchbox pivots.
Figure 7:
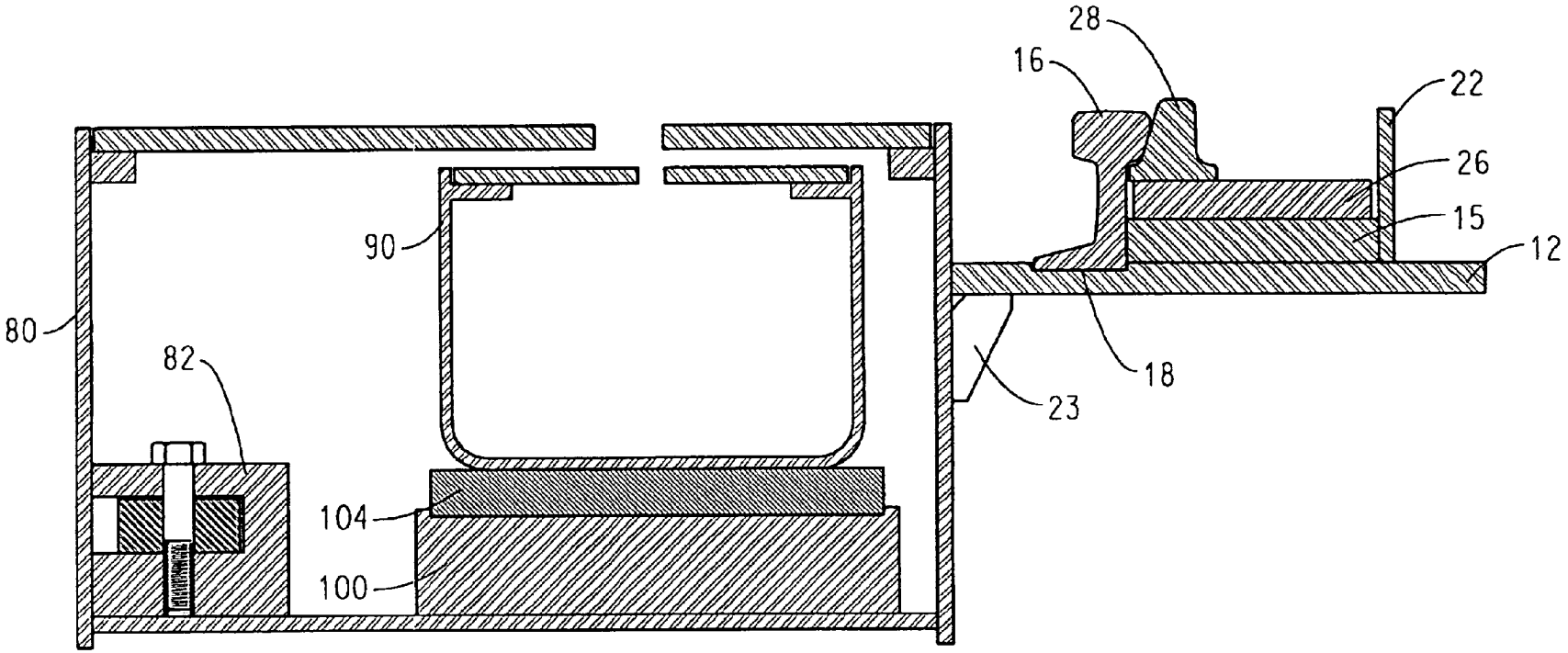
FIG. 7 is a cross-section of the assembly taken on line 7—7 of FIG. 2, showing the Teflon block supporting the inner switch box and the horizontal lever arm connection to the outer switchbox.

The surfaces of the slide plate sections 24, 25, 26 are finely machined to ensure smooth, low-friction motion of tongue 28 between the rails. No lubricant or other friction-reducing device is required. Should dirt or other contaminants scratch slide plate sections 24, 25, 26 such that they no longer function properly, any of slide plate sections 24, 25, 26 are easily removable by removing bolts 27. The widths of slide plate sections 24, 25, 26 are slightly narrower than the gap between web 72 of stock rail 16 and concrete barrier plate 22, as illustrated with slide plate section 26 in FIG. 9. Slide plate sections 24, 25, 26 are bolted with bolts 27 onto corresponding bed plate sections 13, 14, 15 along the length of the tongue switch. FIG. 5 demonstrates the connection between first slide plate section 24 and first bed plate section 13, while FIG. 7 illustrates the connection between third slide plate section 26 and third bed plate section 15. Once tongue 28 is removed, any of slide plate sections 24, 25, 26 can be unbolted and lifted out of the switch for repair or replacement. Third slide plate section 26 also contains a machined opening 60 at the terminal end for insertion of tongue pin 62, as shown in FIG. 10.

Figure 9:
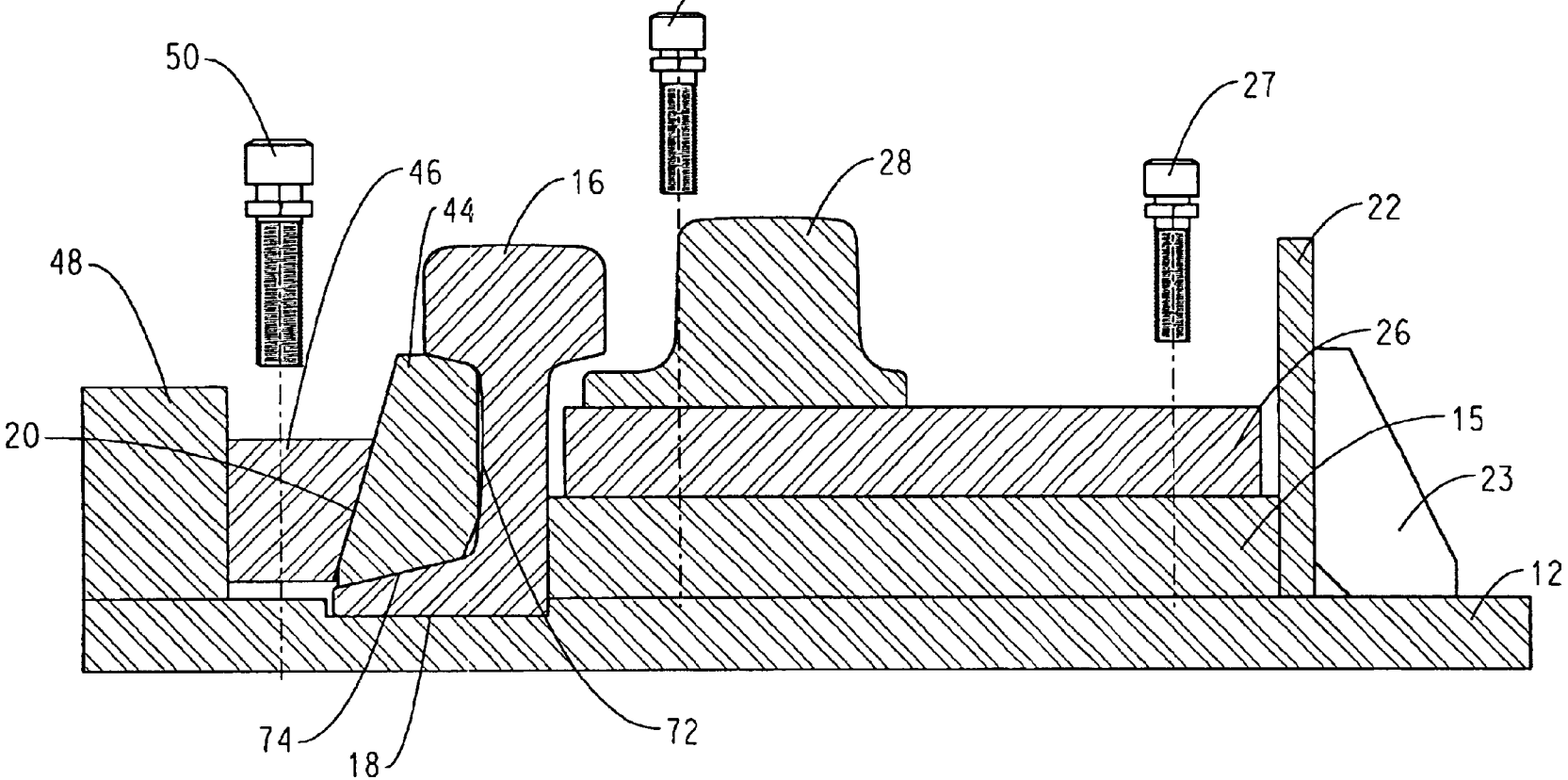
FIG. 9 is a cross-section of the assembly taken on line 9—9 of FIG. 2, showing the full size of the tongue and the third slide plate section resting on the bed plate sections and base plate.

Bed plate sections 13, 14, 15 act as a spacer between slide plate sections 24, 25, 26 and base plate 12, as well as a support for stock rail 16 and the entire tongue switch. Since bed plate sections 13, 14, 15 take up some of the height of stock rail 16, it allows slide plate sections 24, 25, 26 to be thinner, narrower and lighter, making them easier and cheaper to replace, if necessary. Bed plate sections 13, 14, 15 support the inside surface of stock rail web 72, as shown in FIG. 9. This allows the use of floating brace block assemblies 20 only at certain points along the length of the tongue switch, while still holding stock rail 16 securely in the proper position. In addition, the welding of bed plate sections 13, 14, 15 to base plate 12 adds structural strength and stability to the tongue switch. Third bed plate section 15 contains recess 61 for insertion of pivot bearing disc 59, as shown in FIG. 10.

Stock rail 16 is not integrally cast as one piece with any of the underlying plates. The use of a non-integral stock rail 16 allows removal and replacement when the rail becomes damaged or worn, without replacing the entire assembly. Stock rail 16 must mate properly with tongue 28 to allow proper transfer of the train weight between the rail and tongue 28. To ensure this happens, stock rail 16 requires side head machining as in AREMA Plan No. 221-62, Detail 5100, which is incorporated herein by reference.

The floating brace block assembly 20 is best shown in FIG. 9. Stock rail seat 18 in base plate 12 ensures that the stock rail 16 is properly positioned. Floating brace block assemblies 20 hold stock rail 16 against the machined edges of bed plate sections 13, 14, 15 to further ensure that stock rail 16 is properly positioned and stable.

Each floating brace block assembly 20 includes a brace 44, a wedge block 46 and wedge block support 48. Brace 44 is placed on the field side of stock rail 16, resting against web 72 and on base 74 of the rail. The outer surface of brace 44 is angled. Wedge block 46 is then driven down between brace 44 and support 48. Wedge block 46 is bolted into place with bolts 50, making it movable and adjustable. There is no need to drill into stock rail 16 to position it, except to attach the turnout and closure rails and heel block 42. While wedge blocks are known in the railroad industry, their use in a floating brace block assembly, bolted in this manner, is considered to be novel.

Referring now to FIGS. 2 and 6, the box assembly comprises an outer switchbox 80. Outer switchbox 80 houses lever arm 82 and a rodding assembly, which cooperate to translate movement of the tongue 28 to an inner switchbox 90 housed within outer switchbox 80. The rodding assembly comprises a throw rod 86 and a slave rod 88.

Not all tongue switches require a box assembly, because not all switches will be used with an electrically-powered train. The invention therefore encompasses tongue switch assemblies with and without a box assembly. If the tongue switch requires a box assembly, lug 96 extends downward from tongue 28 through one of tongue lug slots 94, which run between slide plate sections 25 and 26, between bed plate sections 14 and 15 and through base plate 12 to connect tongue 28 and a rod assembly, as seen in FIG. 6. The rod assembly is preferably a dogleg throw rod 86.

Figure 8:
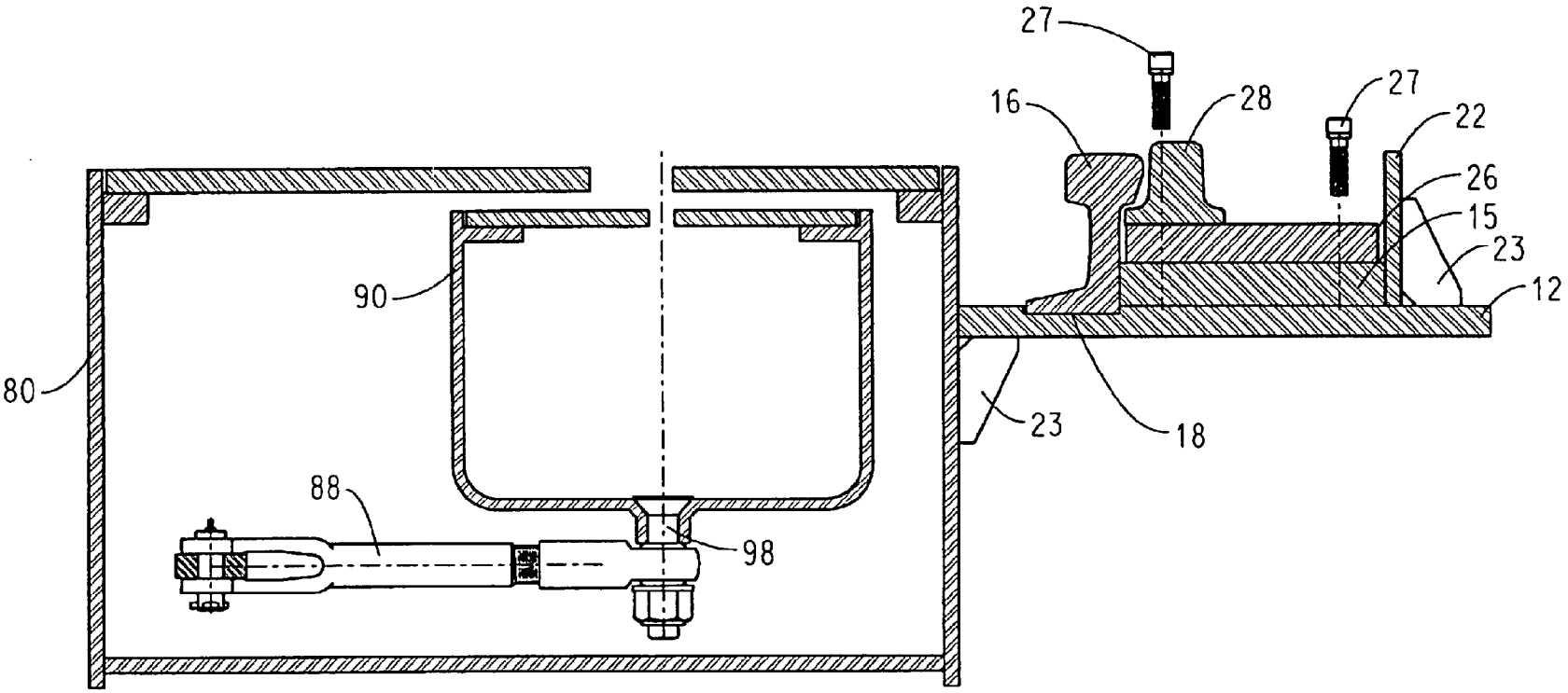
FIG. 8 is a cross-section of the assembly taken on line 8—8 of FIG. 2, showing the slave rod connecting the horizontal lever arm to the inner switchbox.

The position of tongue lug slot 94 through base plate 12, bed plate sections 14, 15 and slide plate sections 25, 26 can be seen in FIGS. 2 and 12, while FIG. 6 illustrates the connection of tongue lug 96 to throw rod 86. FIG. 2 also shows a plan view of lever arm 82 and rodding. Throw rod 86 extends horizontally from tongue lug 96, underneath inner switchbox 90, to lever arm 82. A slave rod 88 connects the other end of the lever arm 82 to the bottom of inner switchbox 90 at the connector 98, as shown in FIG. 8. When the switch machine moves tongue 28 by means of rod 78, the movement is translated through the rodding and lever arm 82 to pivot inner switchbox 90 in the opposite direction. It will be appreciated that this arrangement places the rodding and lever arm 82 on the field side of the inner switchbox 90. Access to lever arm 82 may therefore be gained through a panel on top of the box assembly without removing inner switchbox 90. Once the switch assembly is delivered to the field, throw rod 86 is attached to lug 96 extending down from near the toe of tongue 28, while slave rod 88 is attached to inner switchbox 90 with connector 98. Any adjustments required to properly space and orient the box assembly and the switch can be made at lever arm 82 during and after the box assembly installation. The entire lever arm 82 and rodding 86, 88 assembly is simple and easy to adjust.

Inner switchbox 90 contains the conductor rail, the positions of which are shown in dashed lines in FIG. 1. Inner switchbox 90 is a formed unshaped piece, with welded ends, instead of being a cast piece. It is thus easier to manufacture. Referring to FIG. 7, inner switchbox 90 is maintained in a horizontal position by pedestal 100. Pedestal 100 therefore ensures that all tongue 28 movements are properly translated. At its toe end, inner switchbox 90 pivots about bolt 102 (shown in FIG. 5), and slides on two Teflon blocks 104, one of which is shown in FIG. 7. The amount of movement of inner switchbox 90 is directly related, through lever arm 82, to the amount of movement of tongue 28. It will be appreciated that the arrangement described above causes inner switchbox 90 to move in the direction opposite to that of tongue 28. Inner switchbox 90 therefore follows the direction of the train wheels. The separation between the conductor rail and the selected rail is thus maintained, allowing the collector on the train to keep in contact with the conductor rail.

It will be appreciated by those skilled in the art that other variations to the preferred embodiment described herein may be practised without departing from the scope of the invention, such scope being properly defined by the following claims.

What is claimed is:

1. A railroad tongue switch assembly comprising:

a substrate;

a tongue releasably engageable into said assembly for pivoting motion thereon about a pivot point; and, a stock rail removably seatable in said assembly, said stock rail being releasably held in place in said assembly by means that comprise removable floating brace blocks comprising a brace block, a wedge block support and a wedge block, said wedge block being vertically bolted to said substrate.

2. A railroad tongue switch assembly comprising:

a substrate;

a tongue releasably engageable into said assembly for pivoting motion thereon about a pivot point;

one or more slide plate sections releasably attachable to said substrate and on which said tongue pivots; and, a stock rail removably seatable in said assembly.

3. The assembly of claim 2 wherein said slide plate sections are attached to said substrate by bolts.

4. The assembly of claim 2 wherein said assembly further comprises a retainer releasably mountable over said pivot point.

5. The assembly of claim 4 wherein:

a heel end of said tongue comprises a portion at rail level and a shoulder, at least a portion of said shoulder being lower than flange depth; and, said retainer is releasably attachable to said substrate so as to overlay said portion of said shoulder.

6. The assembly of claim 5 wherein said portion of said shoulder is laterally offset from the flangeway.

7. The assembly of claim 6 wherein said retainer covers substantially only said laterally offset portion when said retainer is attached to said substrate.

8. The assembly of claim 4, 5, 6 or 7 wherein said retainer is attachable by bolts to said substrate.

9. A railroad tongue switch assembly comprising:

a substrate;

a tongue releasably engageable into said assembly for pivoting motion thereon about a pivot point;

a stock rail removably seatable in said assembly; and, a heel end of said tongue comprises a cylindrical pin, said assembly comprises a cylindrical recess, and bronze bearing surfaces lie between and below said pin and said recess surfaces.

10. The assembly of claim 2, 4 or 9 wherein said substrate comprises one or more bed plate sections overlaying at least a portion of a base plate, said bed plate sections being welded to said base plate.

11. The assembly of claim 2, 4, or 9 wherein said substrate comprises a bottom surface and at least two top surfaces, said top surfaces being at different elevations in relation to said bottom surface, and wherein said stock rail is removably seatable on the lower one of said top surfaces.

12. A railroad tongue switch assembly comprising:

a substrate comprising a bottom surface and at least two top surfaces, said top surfaces being at different elevations in relation to said bottom surface, and wherein a first seat for a stock rail is machined into said lower one of said top surfaces;

a tongue releasably engageable into said assembly for pivoting motion thereon about a pivot point; and, a stock rail being removably seatable on the lower one of said top surfaces.

13. The assembly of claim 12 wherein said substrate comprises one or more bed plate sections at least partially overlaying a base plate, said bed plate sections being secured to said base plate, and said first seat being machined into a top surface of said base plate that is not overlain by any of said bed plate sections.

14. A railroad tongue switch assembly comprising:

a substrate comprising one or more bed plate sections overlaying at least a portion of a base plate, said bed plate sections being welded to said base plate;

a tongue releasably engageable into said assembly for pivoting motion thereon about a pivot point; and, a stock rail removably seatable in said assembly.

15. A railroad tongue switch assembly comprising:

a substrate comprising a bottom surface and at least two top surfaces, said top surfaces being at different elevations in relation to said bottom surface;

a tongue releasably engageable into said assembly for pivoting motion thereon about a pivot point; and, a stock rail being removably seatable on the lower one of said top surfaces.

16. A railroad tongue switch assembly comprising:

a substrate;

one or more slide plate sections releasably attachable to said substrate;

a tongue releasably engageable into one of said slide plate sections for pivoting motion thereon about a pivot point;

a stock rail removably seatable on said substrate; and, a first seat for the stock rail is machined into said substrate.

17. The assembly of claim 16 wherein said substrate comprises a bottom surface and at least two top surfaces, said two top surfaces being at different elevations in relation to said bottom surface, said slide plate sections being attached on the higher one of said top surfaces, and said stock rail being seated on the lower one of said top surfaces.

18. The assembly of claim 17 wherein said stock rail is held in position on said lower one of said top surfaces by a brace assembly bracing said stock rail against a side wall of said assembly.

19. The assembly of claim 17 or 18 wherein said seat for the stock rail is machined in said lower one of said top surfaces.

20. The assembly of claim 17 or 18 wherein said substrate comprises one or more first plate sections at least partially overlaying a second plate and being secured thereto, a surface of any of said first plate sections constituting said higher one of said top surfaces and a surface of said second plate constituting said lower one of said top surfaces.

21. The assembly of claim 20 wherein a heel end of said tongue comprises a cylindrical pin, said assembly comprises a cylindrical recess, and bronze bearing surfaces lie between and below the said pin and said recess surfaces.

22. The assembly of claim 21 wherein said assembly further comprises a retainer releasably mounted over said pivot point.

23. The assembly of claim 22 wherein:

a heel end of said tongue comprises a portion at rail level and a shoulder, at least a portion of said shoulder being lower than flange depth; and, said retainer is releasably attachable to said substrate so as to overlay said portion of said shoulder.

24. The assembly of claim 23 wherein said portion of said shoulder is laterally offset from the flangeway and said retainer covers substantially only said laterally offset portion when said retainer is attached to said substrate.

25. A railroad tongue switch assembly comprising:

one or more first plate sections at least partially overlaying a second plate and being welded thereto;

one or more slide plate sections being releasably attached on the top surface of said first plate sections;

a tongue releasably engageable in one of said slide plate sections for pivoting motion thereon about a pivot point;

a stock rail being seated on a portion of said second plate not overlain by said first plate;

said portion of said second plate having first seat machined therein for receiving said stock rail; and, a brace assembly for bracing said stock rail against a side wall of said assembly.

26. The assembly of claim 25 wherein a heel end of said tongue comprises a cylindrical pin, said assembly comprises a cylindrical recess, and bronze bearing surfaces lie between and below the said pin and said recess surfaces.

27. The assembly of claim 25 wherein said assembly further comprises a retainer releasably mountable over said pivot point.

28. The assembly of claim 27 wherein:

a heel end of said tongue comprises a portion at rail level and a shoulder, at least a portion of said shoulder being lower than flange depth; and, said retainer is releasably attachable to said substrate so as to overlay said portion of said shoulder.

29. The assembly of claim 28 wherein said portion of said shoulder is laterally offset from the flangeway.

30. The assembly of claim 29 wherein said retainer covers substantially only said laterally offset portion when said retainer is attached to said substrate.

31. A railroad tongue switch assembly comprising:

a substrate comprising a bottom surface and at least two top surfaces, said to surfaces being at different elevations in relation to said bottom surface;

a tongue releasably engageable into said assembly for pivoting motion thereon about a pivot point;

a first seat machined into said lower one of said top surfaces; and, a stock rail removably seatable on the lower one of said top surfaces, said stock rail being releasably held in place in said assembly by means that comprise removable braces.

32. A railroad tongue switch assembly comprising:

a substrate comprising one or more bed plate sections overlaying at least a portion of a base plate, said bed plate sections being welded to said base plate, and a first seat for the stock rail being machined into said substrate;

a tongue releasably engageable into said assembly for pivoting motion thereon about a pivot point; and, a stock rail removably seatable in said assembly.

33. A railroad tongue switch assembly comprising:

a substrate comprising one or more bed plate sections overlaying at least a portion of a base plate, said bed plate sections being welded to said base plate;

a tongue releasably engageable into said assembly for pivoting motion thereon about a pivot point; and, a stock rail removably seatable in said assembly, said stock rail being releasably held in place in said assembly by means that comprise removable braces.

34. A railroad tongue switch assembly comprising:

a substrate comprising a bottom surface and at least two top surfaces, said top surfaces being at different elevations in relation to said bottom surface;

a tongue releasably engageable into said assembly for pivoting motion thereon about a pivot point; and, a stock rail removably seatable on the lower one of said top surfaces, said stock rail being releasably held in place in said assembly by means that comprise removable braces.

* * * * *

UNITED STATES PATENT AND TRADEMARK OFFICE

CERTIFICATE OF CORRECTION

PATENT NO. : 6,955,326 B2
DATED : October 18, 2005
INVENTOR(S) : O'Brien et al.

It is certified that error appears in the above-identified patent and that said Letters Patent is hereby corrected as shown below:

Column 12,
Line 33, insert the following claim:
35. The assembly of claim 31 wherein said substrate comprises one or more bed plate sections at least partially overlaying a base plate, said bed plate sections being secured to said base plate, and said first seat being machined into a top surface of said base plate that is not overlain by any of said bed plate sections.

Signed and Sealed this

Twenty-seventh Day of December, 2005

JON W. DUDAS
*Director of the United States Patent and Trademark Office*